US010939744B2

(12) United States Patent
Robinson et al.

(10) Patent No.: US 10,939,744 B2
(45) Date of Patent: Mar. 9, 2021

(54) CONVERTIBLE INFANT CARRIER BACKPACK SYSTEM

(71) Applicant: Sak Labs LLC, Roswell, GA (US)

(72) Inventors: Lance Robinson, Roswell, GA (US); Vanel Marc, Riverview, FL (US); Geovanni Suplee, Palmetto, FL (US); Jeremy Losaw, Charlotte, NC (US)

(73) Assignee: SAK LABS LLC, Roswell, GA (US)

( * ) Notice: Subject to any disclaimer, the term of this patent is extended or adjusted under 35 U.S.C. 154(b) by 0 days.

(21) Appl. No.: 16/396,740

(22) Filed: Apr. 28, 2019

(65) Prior Publication Data

US 2019/0328118 A1 Oct. 31, 2019

Related U.S. Application Data

(60) Provisional application No. 62/664,266, filed on Apr. 29, 2018.

(51) Int. Cl.

| | |
|---|---|
| ***A47D 13/02*** | (2006.01) |
| ***A45F 4/02*** | (2006.01) |
| ***A45F 3/04*** | (2006.01) |
| *A45F 3/00* | (2006.01) |

(52) U.S. Cl.

CPC ..... *A45F 4/02* (2013.01); *A45F 3/04* (2013.01); *A47D 13/025* (2013.01); *A45F 2003/003* (2013.01); *A45F 2003/045* (2013.01); *A45F 2004/026* (2013.01)

(58) Field of Classification Search

CPC ..... A47D 13/025; A45F 2003/003; A45F 2003/045

See application file for complete search history.

(56) References Cited

U.S. PATENT DOCUMENTS

| | | | | |
|---|---|---|---|---|
| 5,020,709 A * | 6/1991 | Hoaglan | A47D 13/025 224/155 |
| 5,673,836 A * | 10/1997 | Bush | A41D 13/00 2/94 |
| 5,791,535 A * | 8/1998 | Roan | A47D 13/025 224/153 |
| 5,848,741 A * | 12/1998 | Fair | A47C 7/66 224/160 |
| 6,598,771 B2 * | 7/2003 | Norman | A47D 13/025 224/160 |

(Continued)

*Primary Examiner* — Brian D Nash

(74) *Attorney, Agent, or Firm* — Invention To Patent Services; Alex Hobson

(57) ABSTRACT

A convertible baby carrier backpack system enables using a backpack portion as a backpack alone, a baby carrier portion as a baby carrier alone, or coupling the two portions together to form an integrated baby carrier backpack. A baby carrier has a carrier opening between a back panel and a carrier panel. A back panel is opposite the shoulder straps and configured away from a carrier when used as a baby carrier, while the carrier panel is configured proximal to the carrier when used as a baby carrier. An exemplary baby carrier portion has a carrier attachment feature configured on the back panel that enables detachable attachment of a backpack. An exemplary backpack portion has a backpack attachment feature that is configured to couple with the carrier attachment feature to enable detachable attachment of the backpack portion to the baby carrier portion.

19 Claims, 12 Drawing Sheets

(56) References Cited

U.S. PATENT DOCUMENTS

| | | | | |
|---|---|---|---|---|
| 10,264,895 | B2 * | 4/2019 | Lindeman | A47D 13/025 |
| 2002/0175194 | A1 * | 11/2002 | Norman | A47D 13/025<br>224/160 |
| 2005/0184114 | A1 * | 8/2005 | Hoff | A47D 13/025<br>224/160 |
| 2008/0283559 | A1 * | 11/2008 | Parness | A47D 13/025<br>224/159 |
| 2011/0186605 | A1 * | 8/2011 | Favorito | A47D 13/025<br>224/160 |
| 2012/0298702 | A1 * | 11/2012 | Jung | A47D 13/025<br>224/158 |
| 2015/0196133 | A1 * | 7/2015 | Rosen | A47D 13/025<br>224/160 |
| 2015/0201761 | A1 * | 7/2015 | Wollenberg | A45F 4/02<br>224/576 |
| 2017/0119173 | A1 * | 5/2017 | Telford | A47D 13/025 |
| 2018/0035823 | A1 * | 2/2018 | Landeros | A45C 9/00 |
| 2018/0235379 | A1 * | 8/2018 | Lindeman | A47D 13/025 |
| 2019/0350379 | A1 * | 11/2019 | Antunovic | A47D 13/025 |
| 2019/0350380 | A1 * | 11/2019 | Tsai | A47D 13/025 |

* cited by examiner

CONVERTIBLE INFANT CARRIER BACKPACK SYSTEM

CROSS REFERENCE TO RELATED APPLICATIONS

This application claims the benefit of priority to U.S. provisional patent application No. 62/664,266, filed on Apr. 29, 2018; the entirety of which is hereby incorporated by reference herein.

BACKGROUND OF THE INVENTION

Field of the Invention

The invention relates to a convertible baby carrier backpack system that enables using a backpack portion as a backpack alone, a baby carrier portion as a baby carrier alone, or coupling the two portions together to form an integrated baby carrier and backpack.

Background

People today, especially working parents, are very busy and literally have their hands full. Many utilize baby carriers to free their hands for briefcases, holding other children's hands, cell phones and the like. Babies and toddlers require a lot of travel accessories including diapers, wipes, bottles, toys, pacifiers and the like. Busy parents have to find a way to carry all of these baby accessories, the baby and other personal effects. This is very challenging.

Backpacks, rucksacks, and other "carryable" luggage articles are well-known and in widespread use. Most known backpacks consist of little more than a flexible bag or body defining a box-shaped volume, with a zippered opening and one or more shoulder straps. Further, wearable infant carriers are also well known and in widespread use. Most wearable infant carriers use shoulder and torso straps to secure the carrier to the user and have a padded area for the child to ride in either the forward facing or parent facing directions. Furthermore, said wearable infant carriers can be worn such that the infant is carried on the proximal side of the parent or the distal side of the parent. However, since infant carriers have limited storage space for child care accessories, it is common practice for care givers to use both a backpack, rucksack, or carryable luggage and an infant carrier simultaneously.

Backpacks, rucksacks, and carryable luggage do not interface well with wearable infant carriers. When used concurrently, they frequently get tangled due to multiple straps and complicated strapping requirements. Furthermore, infant carriers have a singular function in that they can only be used to carry an infant requiring the care giver to keep in inventory other items to perform the standard child care duties, specifically a pad or mat that the child can be placed upon during changing. Furthermore, when an infant carrier is in use and the child is removed from the carrier, the caregiver is left with a bundle of straps that hang off of their body that can cause the caregiver to become entangled and potentially ensnared.

Baby carriers support the child against a panel of the baby carrier which may be proximal to the parent or distal from the parent. The baby may fall asleep and their breathing can be compromised if pressed against the baby carrier panel. This is especially problematic when the child is facing the parent while positioned in the infant carrier as their respiratory organs, like their mouth and nose, may be pressed against a non-permeable panel which can limit their ability to breath properly.

SUMMARY OF THE INVENTION

The invention is directed to a convertible baby carrier backpack system that enables using a backpack portion as a backpack alone, a baby carrier portion as a baby carrier alone, or coupling the two portions together to form an integrated baby carrier backpack. A baby carrier has a carrier opening between a back panel and a carrier panel. A back panel is opposite the shoulder straps and configured away from a carrier when used as a baby carrier, while the carrier panel is configured proximal to the carrier when used as a baby carrier. An exemplary baby carrier portion has a carrier attachment feature configured on the baby carrier, such as on the back panel, that enables detachable attachment of a backpack. An exemplary backpack portion has a backpack attachment feature that is configured to couple with the carrier attachment feature to enable detachable attachment of the backpack portion to the baby carrier portion.

An exemplary backpack has a backpack container configured between a distal and proximal panel. A distal panel is opposite the shoulder straps and configured away from the carrier when worn as a backpack. A proximal panel is configured proximal to the carrier when used as a backpack. The shoulder straps typically extend from the proximal panel or away from the backpack on the proximal panel side.

An exemplary attachment feature of the baby carrier and backpack portions may be a zipper, hook-n-loop fastener, straps and buckles and the like. A preferred attachment feature is a zipper with one set of teeth configured on the carrier portion and the mating set of teeth configured along the backpack portion. A slide may be configured on either portion and engage the two sets of teeth to detachably attach the baby carrier portion to the backpack portion. The attachment feature, such as a zipper may extend along a substantial portion of the perimeter of the baby carrier portion and/or the backpack portion, or extend at least about 50% or more about the perimeter, about 75% or more of the perimeter or more or completely around the perimeter of the baby carrier portion. The perimeter of the backpack portion may be measured around the distal panel and the perimeter of the baby carrier portion may be measured around the back panel, for example. In an exemplary embodiment, the attachment feature extends along the top and down some portion of the opposing sides of the baby carrier portion and the backpack portion. In an exemplary embodiment, the attachment feature extends along the top of the baby carrier portion and down both sides to the bottom of the baby carrier portion. An attachment portion may extend complete around the perimeter of the baby carrier portion to produce a ring enclosure with the backpack portion. The attachment feature may extend along the back panel portion of the baby carrier and around the proximal panel of the backpack portion.

The backpack portion may be attached to the back panel of the baby carrier portion and the straps may extend outside of the attachment feature or may be configured within the enclosure formed by the attachment feature, or secured between the proximal panel of the backpack portion and the back panel of the baby carrier portion. The shoulder straps of the baby carrier portion may be used to carrier the integrated baby carrier backpack, wherein the backpack portion is attached to the baby carrier portion.

An exemplary baby carrier portion has shoulder straps that extend from the baby carrier portion, such as from the top of the baby carrier portion and may be coupled with the carrier panel, the paned closest to the carrier. The shoulder straps may extend around the carrier's shoulders and back to the baby carrier portion to form a loop. The shoulder straps may couple back to the carrier panel portion some height up from the bottom of the baby carrier portion, to allow for a leg opening along the sides of the baby carrier portion, between the carrier panel and the back panel. An exemplary baby carrier portion may comprise a waist strap configured to extend in a loop around a carrier's waist. The waist strap may be coupled to the baby carrier portion proximal to the bottom, and below the shoulder strap.

An exemplary baby carrier portion comprises a permeable panel configured on an inside surface of the carrier panel and/or on the inside surface of the back panel, to enable the child retained therein to breath freely, even if they have fallen asleep with their nose and/or mouth pressed against the permeable panel. An exemplary permeable panel has a breathable permeability, or a permeability sufficient for breathing therethrough, such as a Gurley permeability time of about 10 seconds or less, or about 5 second or less as measured by a Gurley Automatic Densometer model 4340, Gurley Precision Instruments, Troy N.Y. A cover may be configured over the permeable panel and the cover may be detachably attachable. The cover may be used when it is very windy and/or cold.

An exemplary convertible baby carrier backpack system has a back panel of the baby carrier portion that is formed by the proximal panel of the backpack portion. The carrier panel may be coupled to the backpack and may extend across the proximal panel of the backpack portion to form a carrier opening between the proximal panel of the backpack and the carrier panel. The proximal panel of the backpack portion forms the back panel of the baby carrier in this configuration. The carrier panel may be configured to detach, or partially detach to facilitate locating the child in the carrier opening. The carrier panel may be attached or detachably attached along opposing sides and along a portion of the bottom to form leg openings for the child's legs. A securing panel may be coupled to the backpack and may extend around a baby carrier portion to secure the baby carrier to the backpack portion. An exemplary securing panel may extend under the straps of the backpack from one side of the backpack to the opposing side of the backpack to retain the baby carrier therebetween the securing panel and the proximal panel of the backpack.

The summary of the invention is provided as a general introduction to some of the embodiments of the invention, and is not intended to be limiting. Additional example embodiments including variations and alternative configurations of the invention are provided herein.

BRIEF DESCRIPTION OF SEVERAL VIEWS OF THE DRAWINGS

The accompanying drawings are included to provide a further understanding of the invention and are incorporated in and constitute a part of this specification, illustrate embodiments of the invention, and together with the description serve to explain the principles of the invention.

Figure 1:
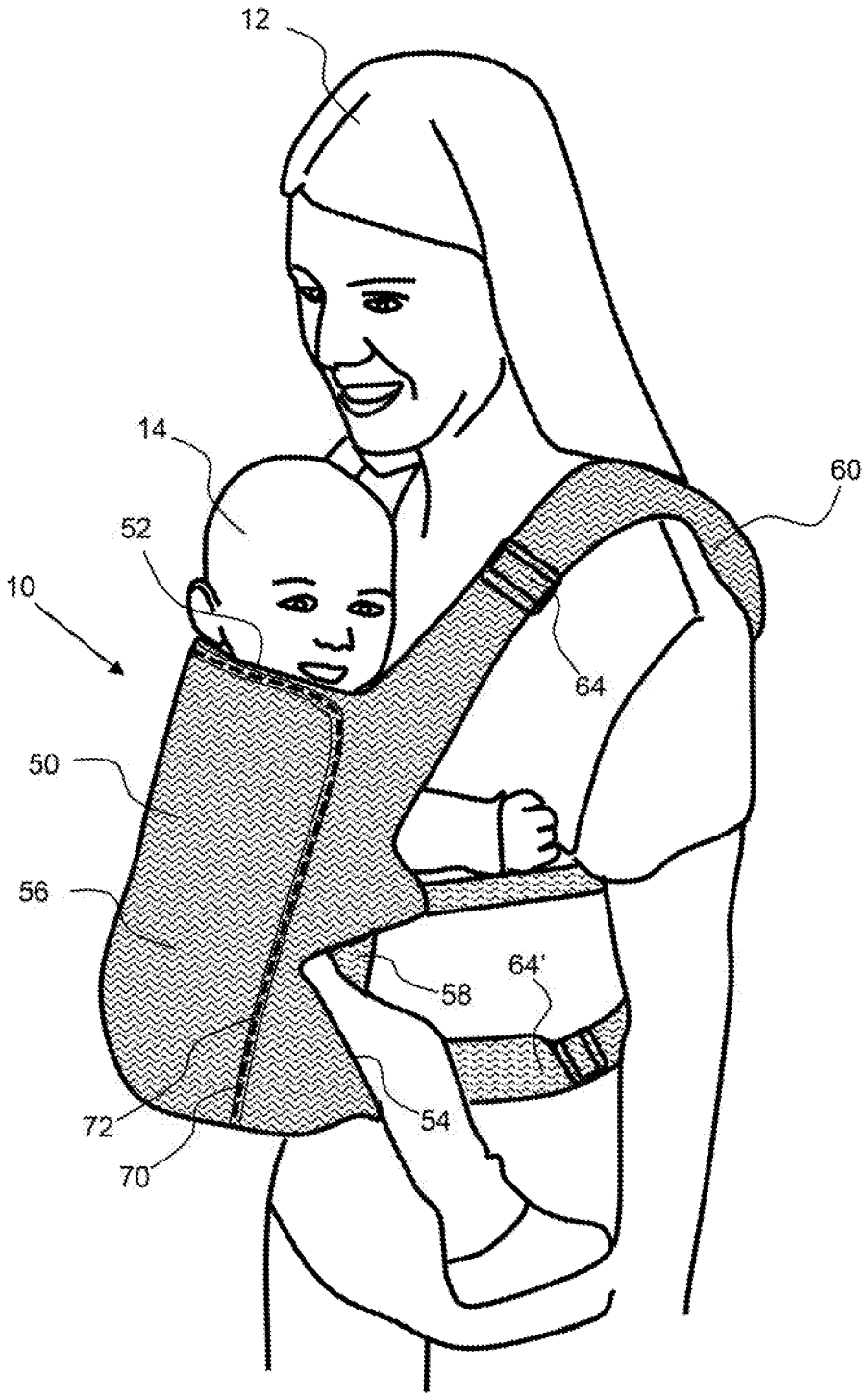
FIG. 1 shows a front perspective view of a person carrying a baby with an exemplary baby carrier portion of an exemplary convertible baby carrier backpack system.

Corresponding reference characters indicate corresponding parts throughout the several views of the figures. The figures represent an illustration of some of the embodiments of the present invention and are not to be construed as limiting the scope of the invention in any manner. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

DETAILED DESCRIPTION OF THE ILLUSTRATED EMBODIMENTS

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and are illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications, improvements are within the scope of the present invention.

Definitions

A baby carrier may be configured to carry an infant, toddler or small child but is referred to simply as a baby carrier herein.

Figure 2:
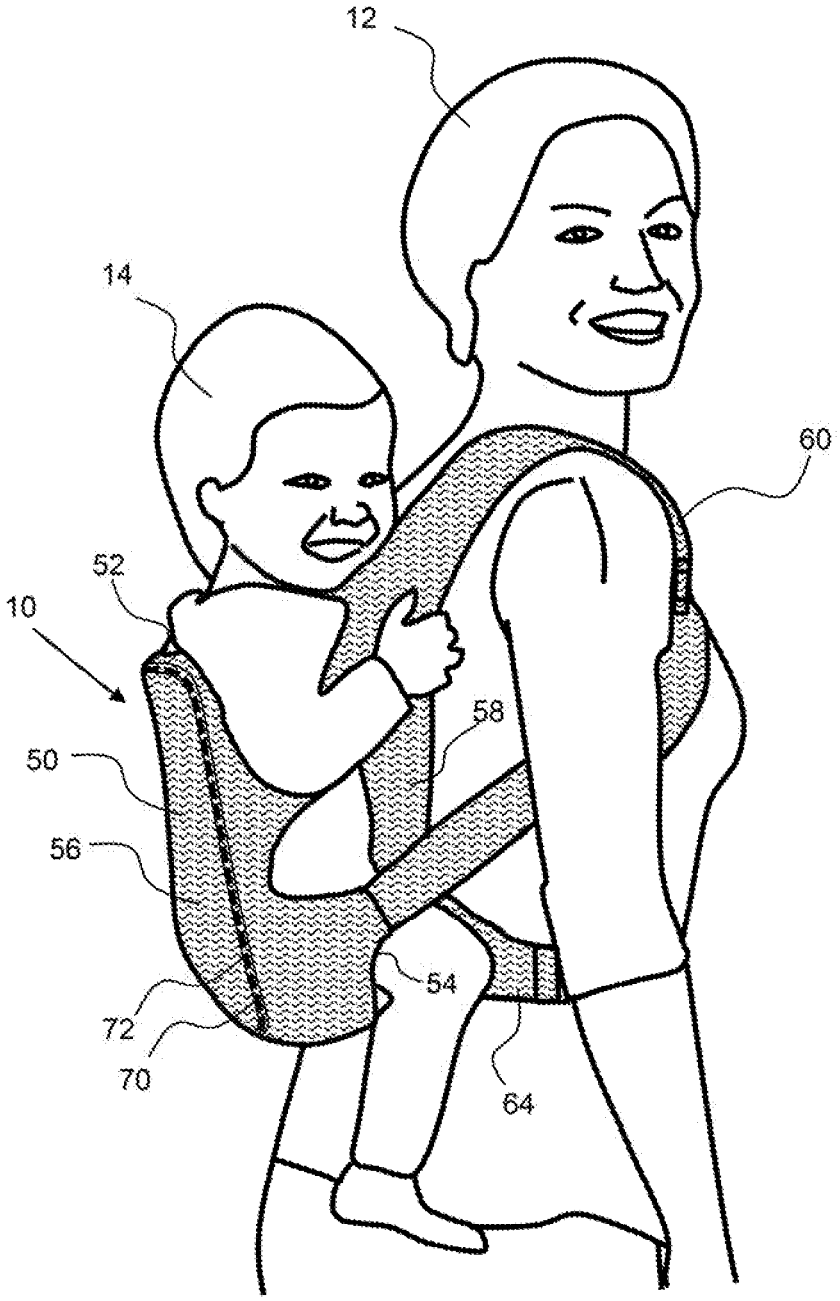
FIG. 2 shows a back perspective view of a person carrying a baby person carrying a baby with a baby carrier portion of an exemplary convertible baby carrier backpack system.

Referring now to FIGS. 1 and 2, As shown in FIG. 1, a baby carrier portion 50 of an exemplary convertible baby carrier backpack system 10 enables a person or carrier 12 to carry the baby 14, such as along the person's front, as shown in FIG. 1, and along the carrier's back, as shown in FIG. 2. The baby carrier portion 50 has a carrier opening 52 between the back panel 56 and the carrier panel 58, configured along the carrier person, to receive and retain the baby. Shoulder straps 60 extend around the person's shoulders and a waist strap 64 extends around the person's waist to secure the baby carrier portion to the carrier. The shoulder and waist straps may have buckles 64, 64' to allow tightening of the straps. The shoulder strap forms a loop extending from the top and having a return connection configured between the top extension and the bottom of the carrier panel portion, or above the waist strap. The baby's leg extends out through the leg openings 54. The exemplary baby carrier portion 50 has an attachment feature 70 such as a zipper 72 to allow the baby carrier portion to be detachably attached to a backpack portion of the convertible baby carrier backpack system. The attachment feature extends a substantial portion around the perimeter of the back panel of the baby carrier portion, including along the top and down opposing sides of the back panel portion.

Figure 3:
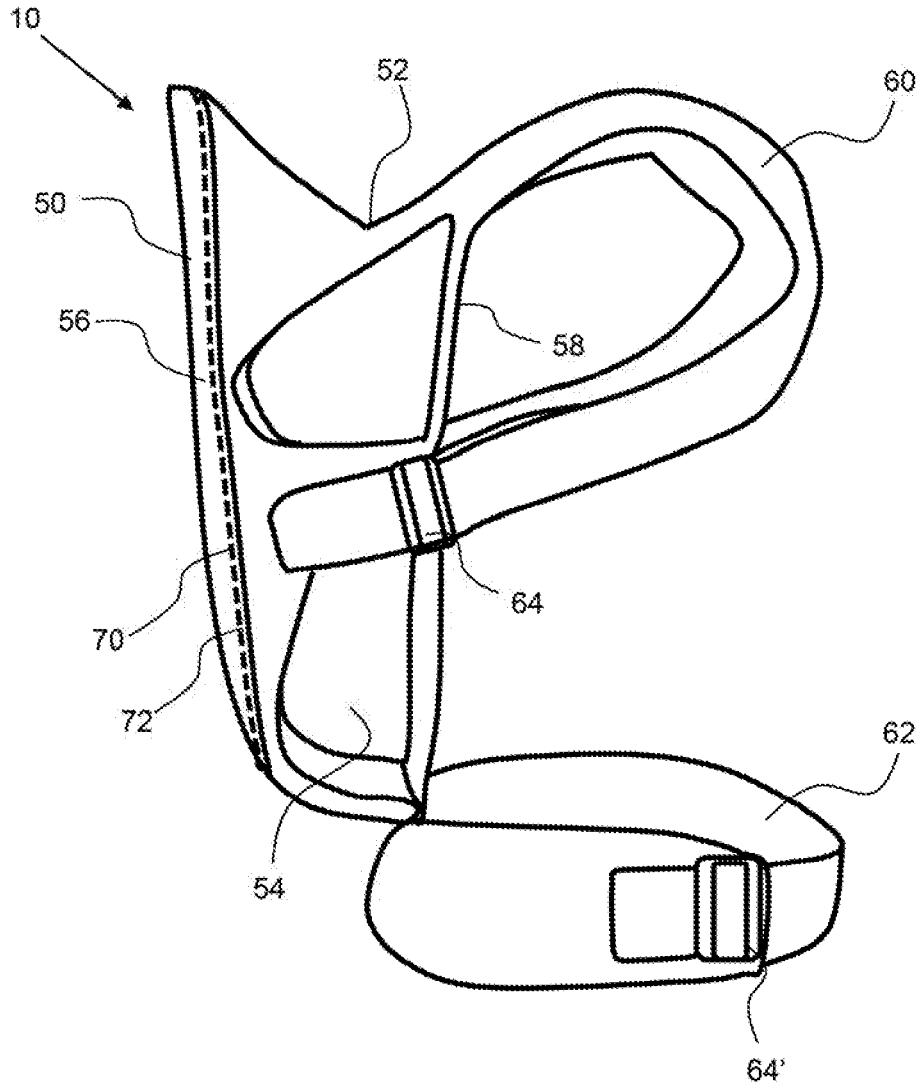
FIG. 3 shows a side view of a baby carrier portion of an exemplary convertible baby carrier backpack system.
Figure 4:
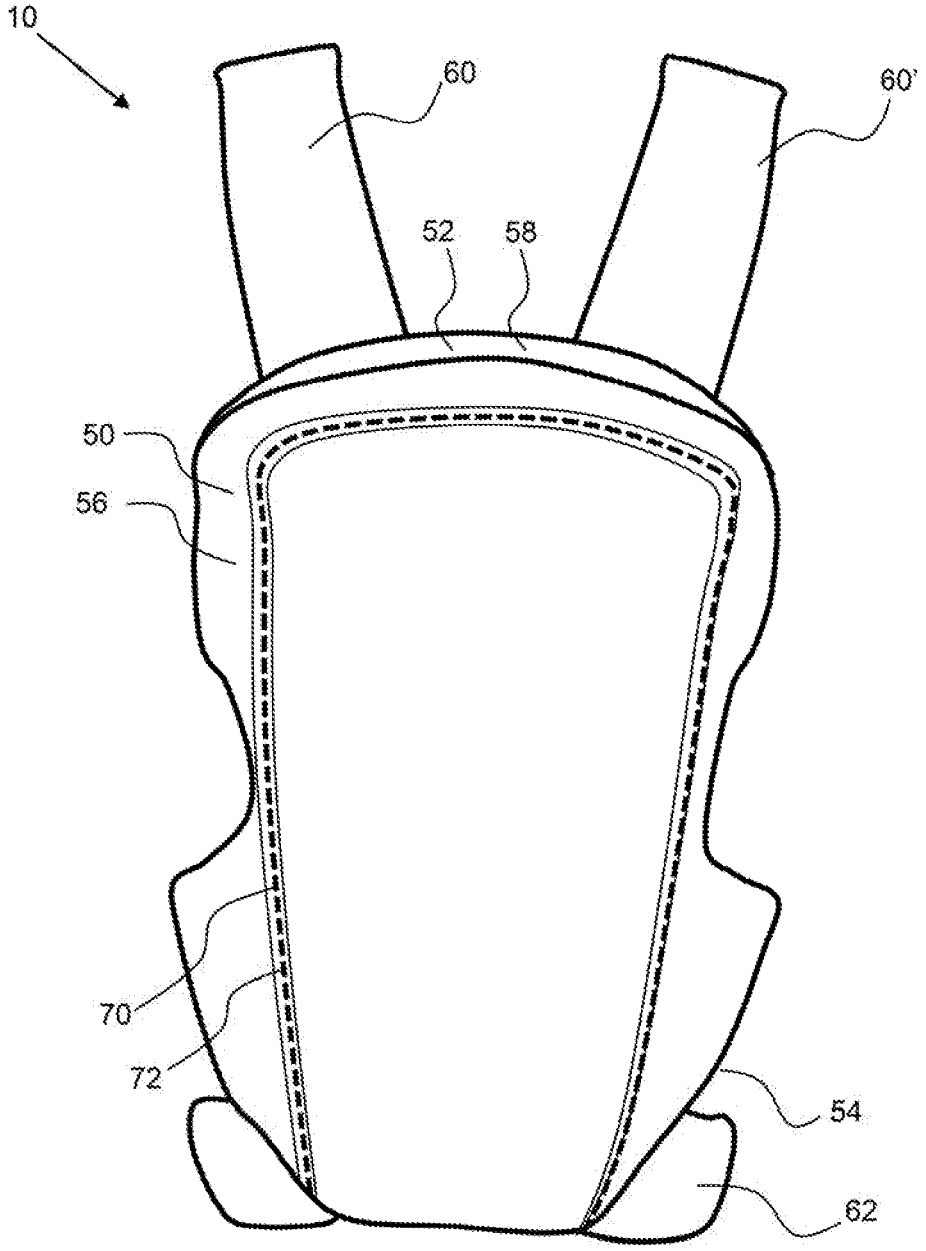
FIG. 4 shows a back view of a baby carrier portion of an exemplary convertible baby carrier backpack system.
Figure 5:
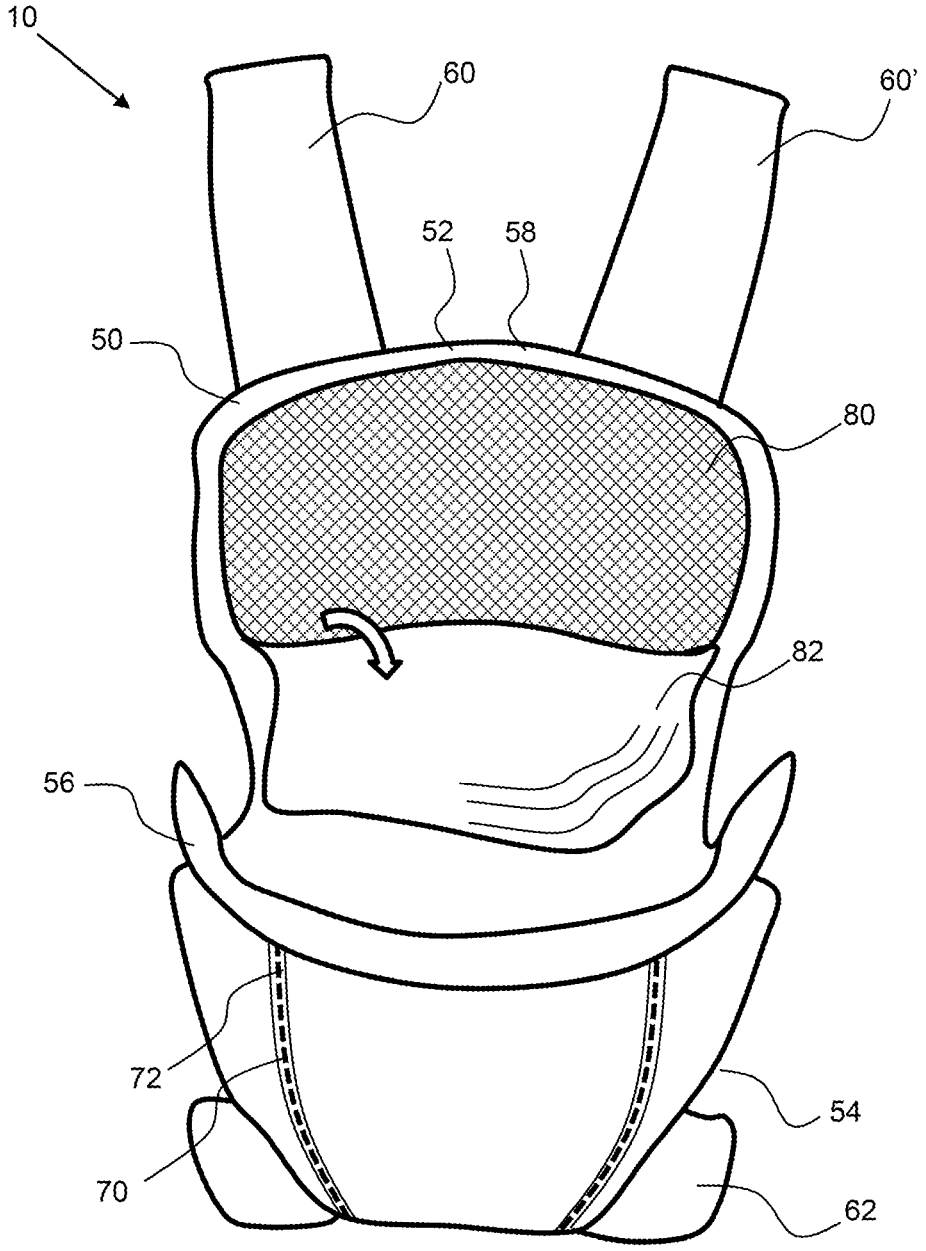
FIG. 5 shows a back view of a baby carrier portion of an exemplary convertible baby carrier backpack system with the back panel pulled down to show the permeable panel along the carrier panel.

Referring now to FIGS. 3 to 5, a baby carrier portion 50 of an exemplary convertible baby carrier backpack system 10 has a carrier opening 52 between a carrier panel 58, on a carrier side, and back panel 56, on a back side, for receiving a baby. A pair of shoulder straps 60 and a waist strap 62 enable the baby carrier portion to be secured to a person. A buckle 64 may be used to adjust the shoulder or waist strap. An attachment feature 70, such as a zipper 72 is configured along the back panel to enable detachable attachment of a backpack portion (not shown). The leg opening 54 allows a baby's legs to extend out from the baby carrier and is configured between the bottom of the baby carrier portion the connection of the bottom loop of the shoulder strap. As shown in FIG. 4, the carrier attachment feature 70 extends a substantial portion of the perimeter of the back panel including, along the top and down the two opposing sides, and may extend completely around the perimeter including along the bottom. As shown in FIG. 5, a permeable panel 80 is configured on the carrier panel 58 to allow a baby to breathe through the permeable panel. As described herein, the permeable panel may have a permeable that is effective for breathing therethrough. A permeable cover 82 may be removed from the permeable panel and may be detachable from the baby carrier portion 50.

Figure 6:
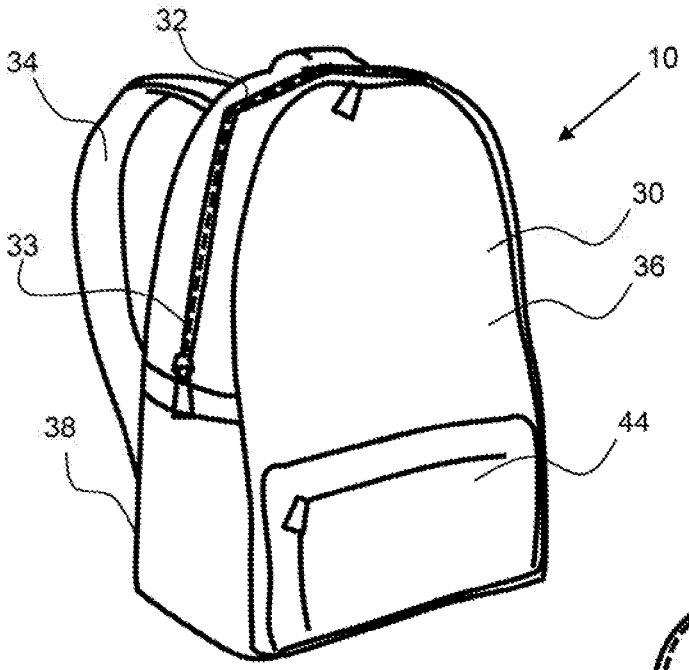
FIG. 6 shows a back perspective view of a backpack portion of an exemplary convertible baby carrier backpack system.
Figure 7:
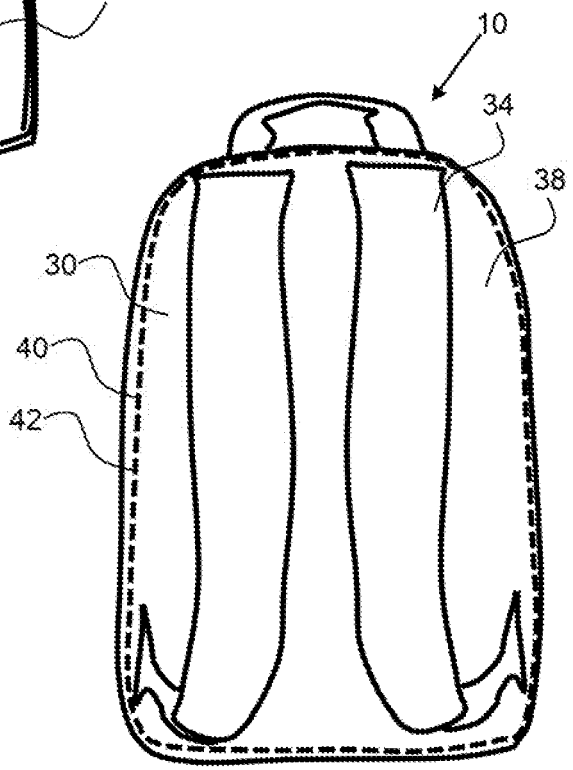
FIG. 7 shows a front view of a backpack portion of an exemplary convertible baby carrier backpack system.
Figure 8:
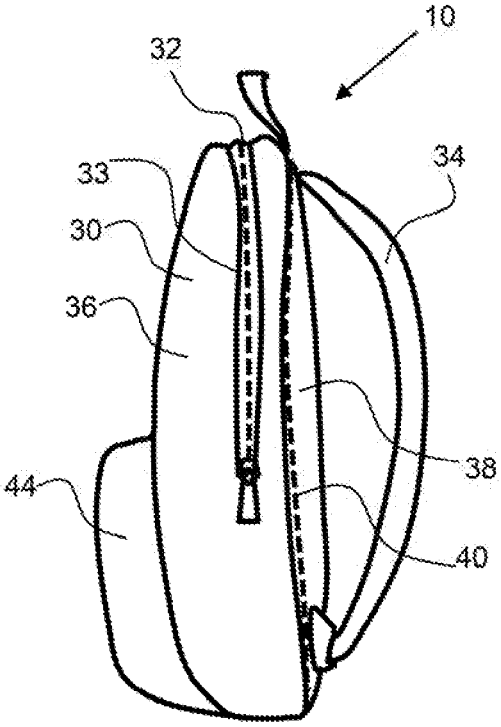
FIG. 8 shows a side view of a backpack portion of an exemplary convertible baby carrier backpack system.

Referring now to FIGS. 6 to 8, a backpack portion 30 of an exemplary convertible baby carrier backpack system 10 has an opening 32 for receiving articles into the backpack compartment 33. Contents may be stored within the backpack compartment between the distal panel 36 on the distal side, or panel that is furthest from the person carrying the backpack, and the proximal panel 38 on the proximal side, the panel that rests along the person's back when carrying the backpack as a backpack. The backpack portion also has a pair of shoulder straps 34 for carrying the backpack. The backpack may have multiple compartments, or a secondary compartment 44 having a separate opening. The backpack portion has an attachment feature 40, such as a zipper 42 for detachably attaching the backpack to the baby carrier portion. The backpack attachment feature 40 may be configured to couple with the carrier attachment feature and may also extend a substantial portion around the perimeter of the proximal panel 38 of the backpack portion 30. As shown in FIG. 7, the backpack attachment feature extends completely around the perimeter of the proximal panel 38 of the backpack portion. Note that the attachment feature extends around the shoulder straps 34.

Figure 9:
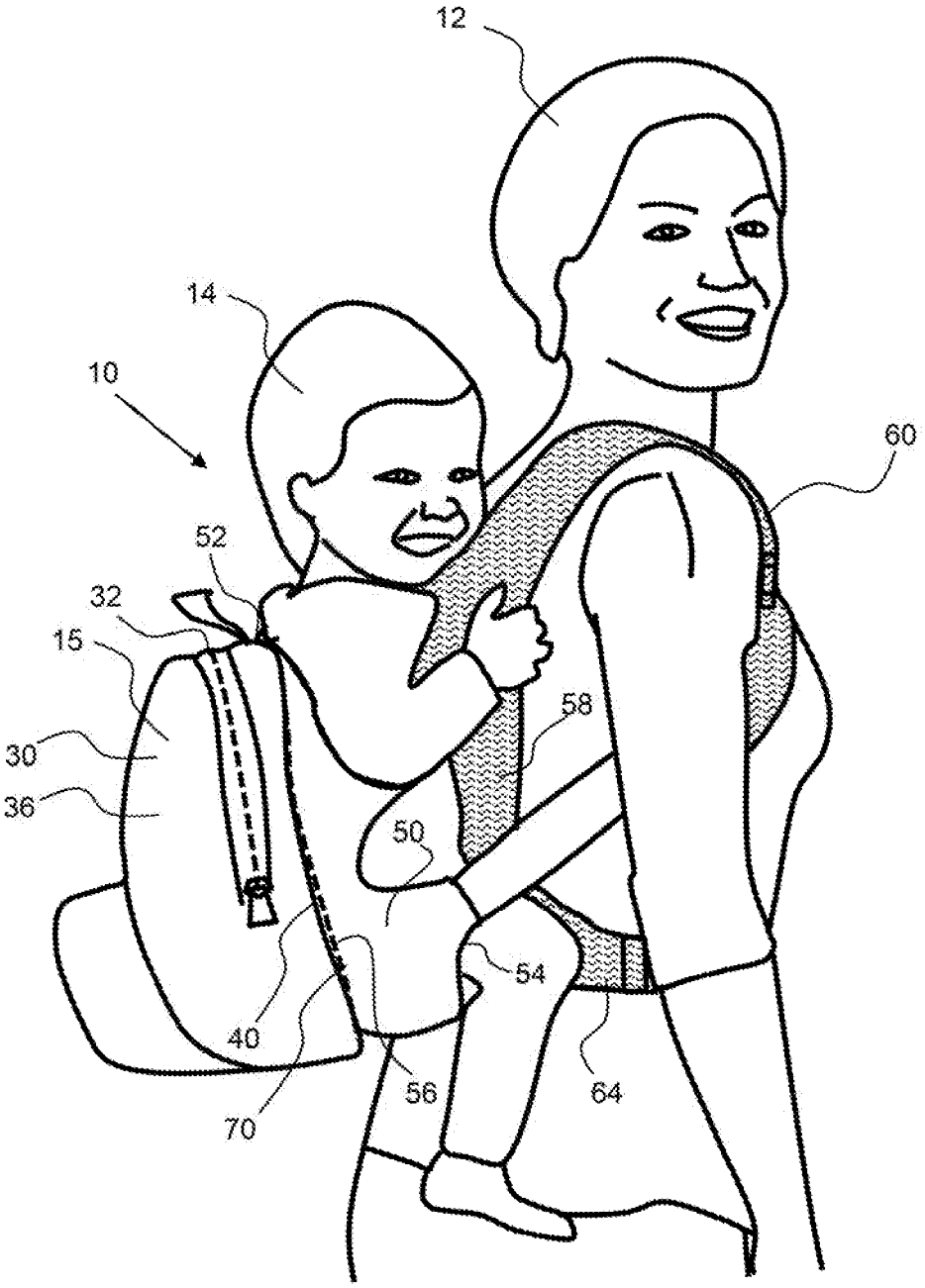
FIG. 9 shows a back perspective view of a person carrying a baby with an exemplary convertible baby carrier backpack system with the baby carried on the person's back and the backpack portion coupled to the baby carrier portion via the attachment feature.

As shown in FIG. 9, a person is carrying a baby 14 with an integrated baby carrier backpack 15. The baby 14 is configured on the person's 12 back and the backpack portion 30 is coupled to the baby carrier portion 50 via the attachment features 40 and 70. A zipper may be coupled between the baby carrier portion and the backpack portion to secure the two portions of the convertible baby carrier backpack system 10 together.

Figure 10:
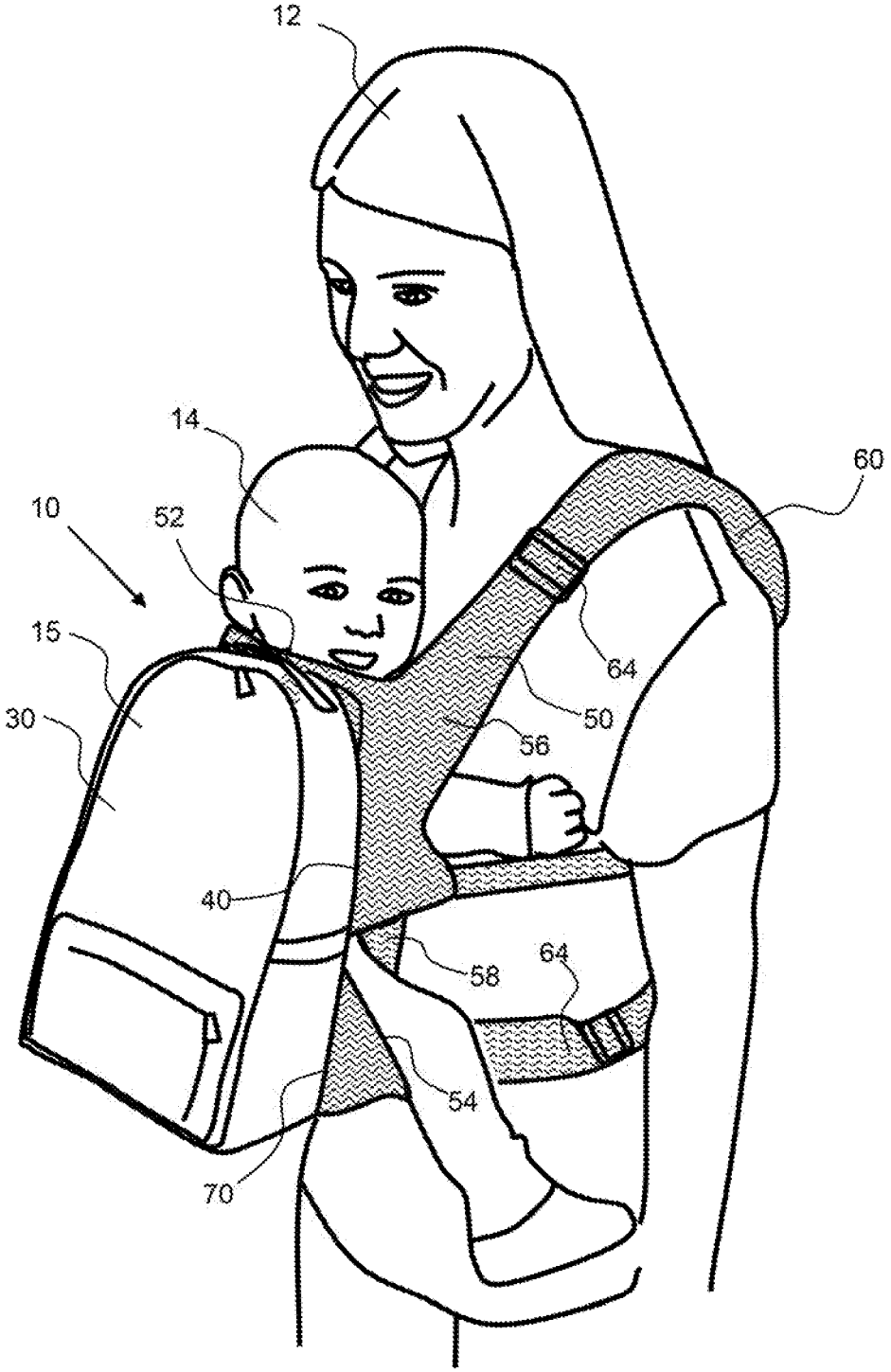
FIG. 10 shows a front perspective view of a person carrying a baby with an exemplary convertible baby carrier backpack system with the baby carried on the person's front and the backpack portion coupled to the baby carrier portion via the attachment feature

As shown in FIG. 10 a person 12 is carrying a baby 14 with an exemplary an integrated baby carrier backpack 15. The baby is configured on the person's front-side and the backpack portion 30 is coupled to the baby carrier portion 50 via the attachment features 40 and 70. A zipper may be coupled between the baby carrier portion and the backpack portion to secure the two portions of the convertible baby carrier backpack system 10 together.

Figure 11:
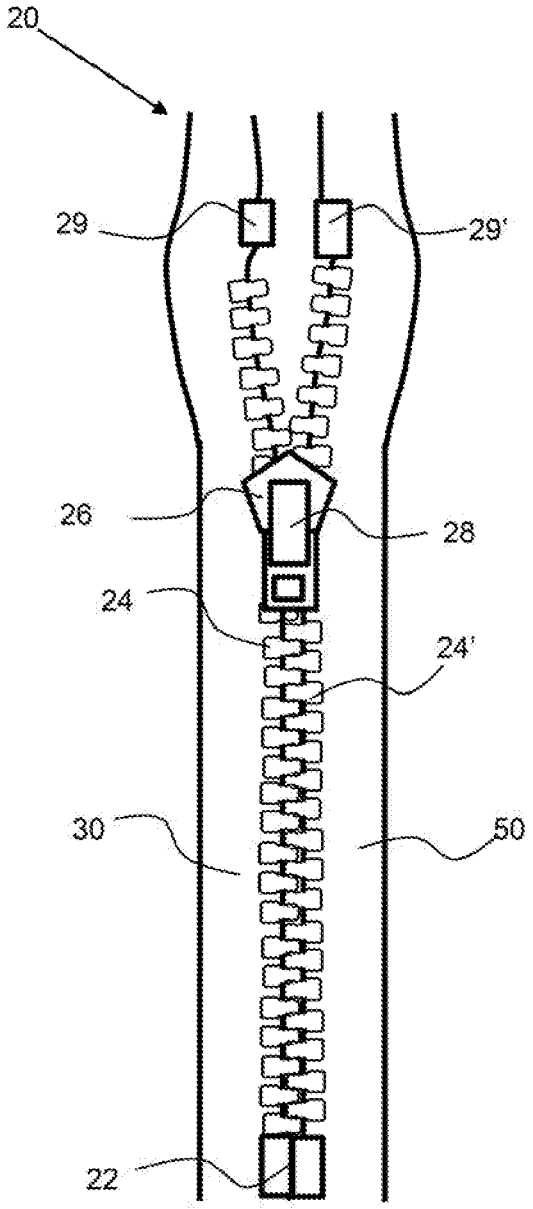
FIG. 11 shows an exemplary zipper attachment feature.

As shown in FIG. 11, an attachment feature may be a zipper 20, wherein a portion of the zipper is configured on the baby carrier portion 50 and a portion is configured on the backpack portion 30. An exemplary zipper has a slide 26 configured on one side of the zipper and a slide coupler 22 on the opposing and mating side of the zipper. The slide is configured over the slide coupler and then slides along the teeth 24, 24' to connect the teeth. A pull 28 may be coupled to the slide to allow the slide to be slid easily by hand. A pair of stops 29, 29' may be configured at the end of the zipper. The slide may be configured on either side of the zipper with the slide coupler configured on the opposing side.

Figure 12:
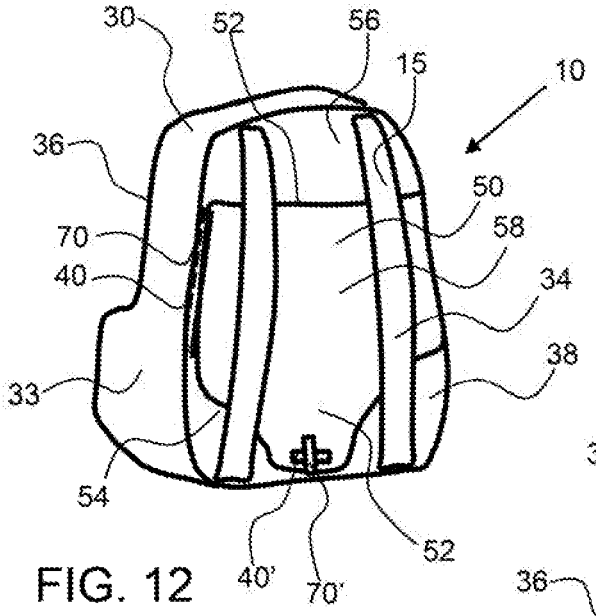
FIG. 12 shows a back view of an exemplary integrated baby carrier backpack having a carrier panel attached to the backpack portion.
Figure 13:
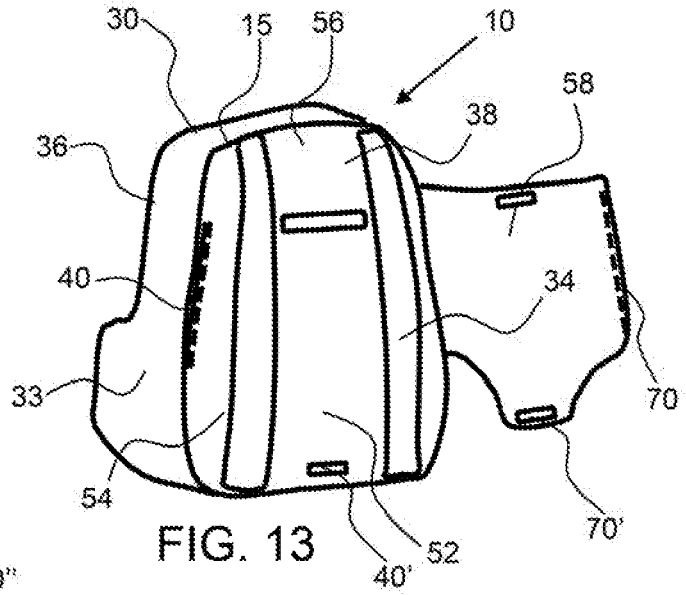
FIG. 13 shows a back view of the exemplary integrated baby carrier backpack shown in FIG. 12, having the carrier panel partially detached from the backpack portion.
Figure 14:
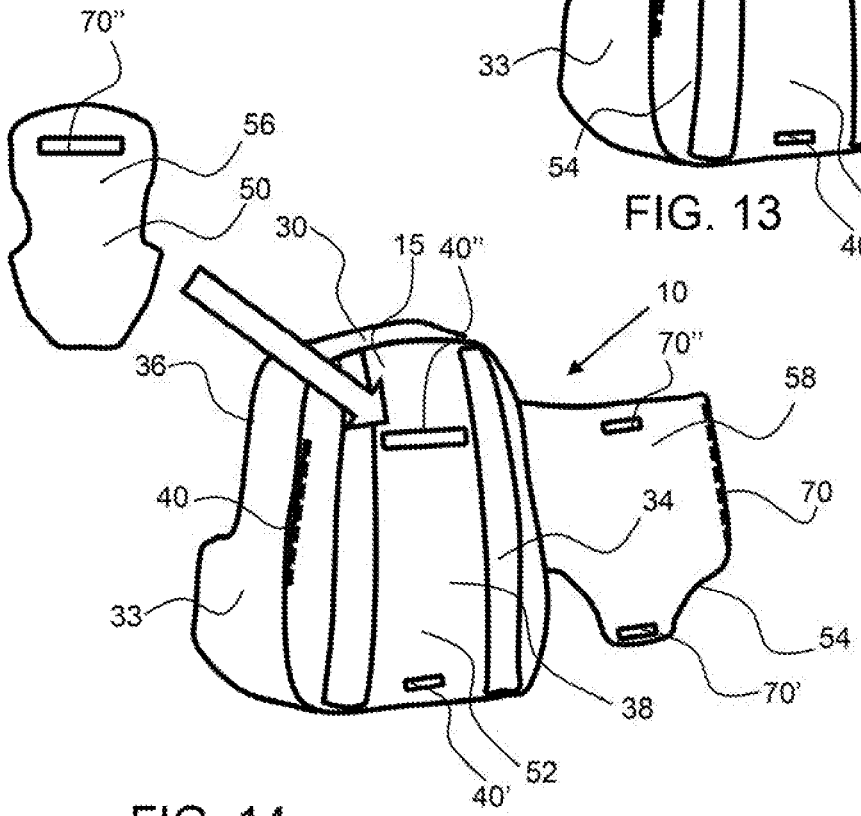
FIG. 14 shows a back view of an exemplary convertible baby carrier backpack system having a back panel of the baby carrier portion detached from the backpack portion and the carrier panel partially detached from the backpack portion.
Figure 15:
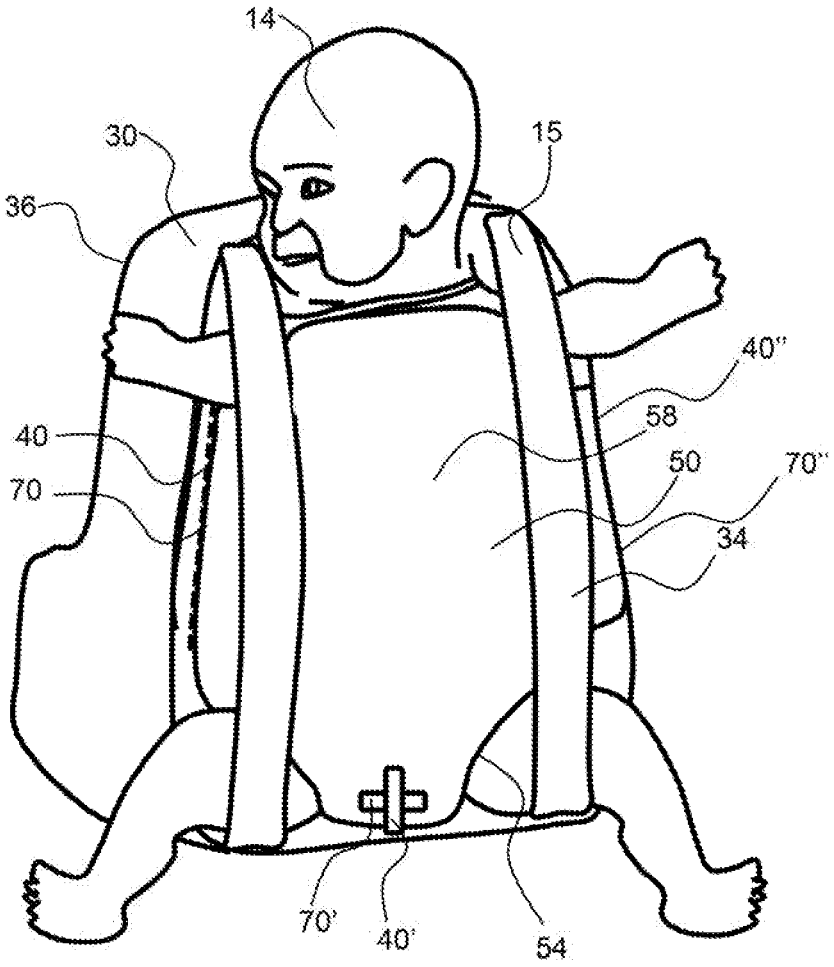
FIG. 15 shows a back view of an exemplary integrated baby carrier backpack having a baby configured between the carrier panel of the baby carrier portion and the backpack portion.

Referring now to FIGS. 12 to 15, an exemplary integrated baby carrier backpack 15 has a carrier panel 58 attached to the backpack portion 30. A carrier opening 52 is formed between the carrier panel and the back panel 56, which may be the proximal panel 38 of the backpack portion 30. As shown in FIG. 12, the carrier panel may be attached to the backpack portion by carrier attachment features 70, 70' that attach to corresponding backpack attachment features 40, 40', respectively. As shown in FIG. 13, the carrier panel 58 is detached from backpack attachment features 40, 40' and is swung out away from the backpack portion. The carrier panel may be completely detachable from the backpack portion. As shown in FIG. 14, a back panel 56 of the baby carrier portion 50 is detachably from the backpack portion 30. The back panel may attach to backpack attachment features 40' and 40" for example by carrier attachment features 70', 70" respectively. The carrier panel 58 may then attach to the backpack portion to form the carrier opening 52 between the back panel and the carrier panel. As shown in FIG. 15, an exemplary integrated baby carrier backpack 15 has a baby 14 configured between the carrier panel 58 of the baby carrier portion 50 and the backpack portion 30. Leg opening 54 are configured between attachments on the opposing side of the backpack portion 40, 70, and 40" and 70", and by the bottom attachment features 40', 70'. The attachment features 40' and 70' may be a latch, wherein a portion of the latch, the backpack attachment feature 40' extends through a carrier attachment feature 70', an opening in the carrier panel 58. The latch may be turned or otherwise manipulated to secure the carrier panel to the backpack portion. Note that the baby 14 may be carried facing the backpack or away from the backpack.

Figure 16:
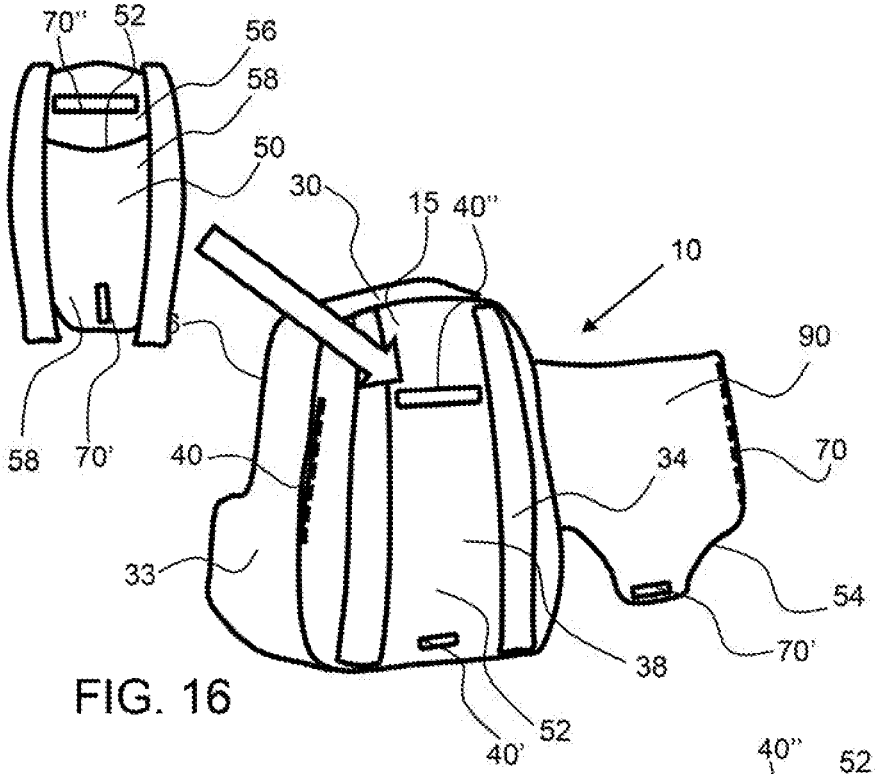
FIG. 16 shows a perspective view of an exemplary convertible baby carrier backpack system having a baby carrier portion that is detachably attachable to a backpack portion 30 and a securing panel 90 that extends from the backpack portion around the baby carrier portion to secure the two portions together.
Figure 17:
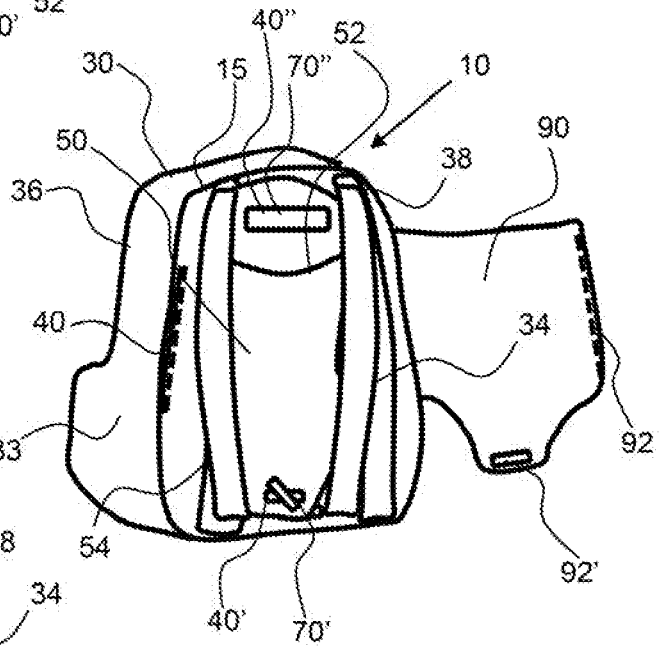
FIG. 17 shows the exemplary convertible baby carrier backpack system shown in FIG. 16 with the baby carrier portion coupled to the backpack portion.
Figure 18:
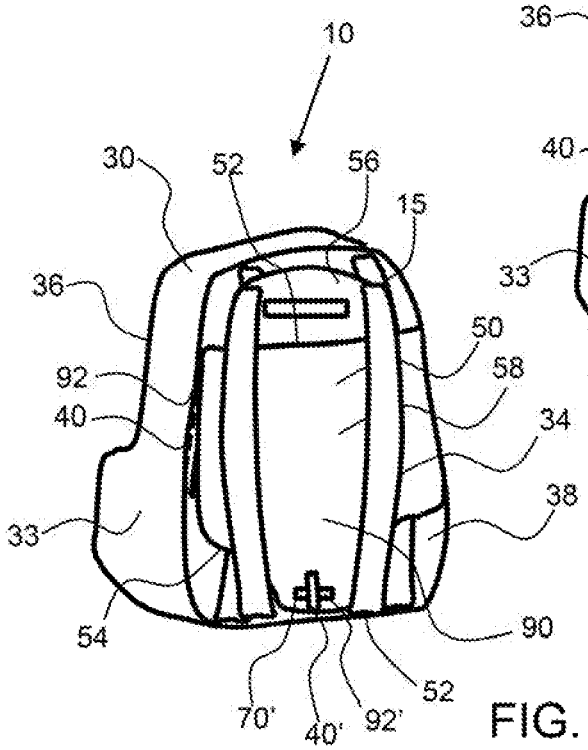
FIG. 18 shows the exemplary convertible baby carrier backpack system shown in FIG. 17 with the securing panel configured under the straps of the baby carrier portion and from one side of the backpack to the opposing side of the backpack to secure the baby carrier portion to the backpack portion.

Referring now to FIGS. 16 to 18, an exemplary convertible baby carrier backpack system 10 has a baby carrier portion 50 that is detachably attachable to a backpack portion 30 and a securing panel 90 that extends from the backpack portion around the baby carrier portion to secure the two portions together. As shown in FIG. 16, the baby carrier portion 50 is detached from the backpack portion 30. A securing panel 90 is attached to one side of the backpack portion and may be detachably attachable to the backpack portion. As shown in FIG. 17, the baby carrier portion has been coupled to the backpack portion. The baby carrier attachment feature 70" is coupled or attached to attachment feature 40" of the backpack. Likewise, the baby carrier attachment feature 70' is coupled to or attached to the backpack attachment feature 40'. These attachment features may be hook and loop fasteners or a latching attachment feature, wherein a latch extension extends from the backpack portion through a latch aperture in the baby carrier portion. The latch extension may be rotated, as shown in FIG. 17 to secure the two components together. As shown in FIG. 18, the securing panel extends under the shoulder straps of the baby carrier portion and across the carrier panel 58 of the baby carrier to the opposing side of the backpack portion, where it secured by attachment features, 92 to 40.

It will be apparent to those skilled in the art that various modifications, combinations and variations can be made in the present invention without departing from the scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. A convertible baby carrier backpack system comprising:

a) a backpack portion comprising:
- i) a distal panel on a distal side;
- ii) a proximal panel on a proximal side;
- iii) a backpack container configured between the distal panel and the proximal panel;
- iv) a backpack opening into the backpack container;
- v) shoulder straps that extend from the proximal side;
- vi) a backpack attachment feature configured on the proximal side;

b) a baby carrier portion comprising:
- i) a back panel configure along a back side;
- ii) a carrier panel configured along a carrier side;
- iii) a carrier opening between the back panel and carrier panel for receiving a baby therein;
- iv) shoulder straps that extend from the carrier side;
- v) a carrier attachment feature configured to detachably attach the backpack portion to the baby carrier portion by engagement with the backpack attachment feature;

wherein the carrier attachment feature and the backpack attachment feature couple together to form a zipper.

2. The convertible baby carrier backpack system of claim 1, wherein the zipper extends at around at least 50% of a perimeter of the back side of the baby carrier portion.

3. The convertible baby carrier backpack system of claim 2, wherein zipper extends at least along a top of the back side, and from the top of the back side down along opposing sides of the back side.

4. The convertible baby carrier backpack system of claim 1, wherein the zipper extends completely around the perimeter of the back side of the baby carrier portion.

5. The convertible baby carrier backpack system of claim 1, wherein the shoulder straps of the baby carrier portion extends from a top of the baby carrier portion to form a loop that connects back to the baby carrier portion; wherein leg openings are configured below the shoulder strap in the baby carrier portion.

6. The convertible baby carrier backpack system of claim 1, wherein the baby carrier portion further comprises a waist strap that extends from a first side in a loop to a second side of the baby carrier portion.

7. The convertible baby carrier backpack system of claim 1, wherein the baby carrier portion further comprises a permeable panel configured on an inside surface of the carrier panel.

8. The convertible baby carrier backpack system of claim 7, wherein the permeable panel has a breathable permeability sufficient for breathing therethrough.

9. The convertible baby carrier backpack system of claim 1, wherein the back panel of the baby carrier portion is formed by the proximal panel of the backpack portion and wherein the carrier panel is attached to the backpack portion to form the carrier opening between the carrier panel and the proximal panel of the backpack.

10. The convertible baby carrier backpack system of claim 9, wherein the carrier panel is detachably attachable to the backpack.

11. The convertible baby carrier backpack system of claim 9, wherein carrier panel is attached along opposing sides of the backpack and along a bottom of the carrier panel to form leg openings between the carrier panel and the back portion of the backpack.

12. A convertible baby carrier backpack system comprising:

a) a backpack portion comprising:
- i) a distal panel on a distal side;
- ii) a proximal panel on a proximal side;
- iii) a backpack container configured between the distal panel and the proximal panel;
- iv) a backpack opening into the backpack container;

v) shoulder straps that extend from the proximal side;
vi) a backpack attachment feature configured on the proximal side;

b) a baby carrier portion comprising:
i) a back panel configure along a back side;
ii) a carrier panel configured along a carrier side;
iii) a carrier opening between the back panel and carrier panel for receiving a baby therein;
iv) shoulder straps that extend from the carrier side;

a carrier attachment feature configured to detachably attach the backpack portion to the baby carrier portion by engagement with the backpack attachment feature;

wherein the baby carrier portion further comprises a permeable panel configured on an inside surface of the carrier panel; and wherein the permeable panel has a breathable permeability sufficient for breathing therethrough; and wherein the permeable panel is configured along a top portion of the inside surface of the carrier side.

13. A convertible baby carrier backpack system comprising:

a) a backpack portion comprising:
i) a distal panel on a distal side;
ii) a proximal panel on a proximal side;
iii) a backpack container configured between the distal panel and the proximal panel;
iv) a backpack opening into the backpack container;
v) shoulder straps that extend from the proximal side;
vi) a backpack attachment feature configured on the proximal side;

b) a baby carrier portion comprising:
i) a back panel configure along a back side;
ii) a carrier panel configured along a carrier side;
iii) a carrier opening between the back panel and carrier panel for receiving a baby therein;
iv) shoulder straps that extend from the carrier side;

a carrier attachment feature configured to detachably attach the backpack portion to the baby carrier portion by engagement with the backpack attachment feature;

wherein the back panel is detachably attachable to the proximal panel of the backpack and wherein the carrier panel is attached to the backpack portion to form the carrier opening between the carrier panel and the proximal panel of the backpack.

14. A convertible baby carrier backpack system comprising:

a) a backpack portion comprising:
i) a distal panel on a distal side;
ii) a proximal panel on a proximal side;
iii) a backpack container configured between the distal panel and the proximal panel;
iv) a backpack opening into the backpack container;
v) shoulder straps that extend from the proximal side;
vi) a backpack attachment feature configured on the proximal side;

b) a baby carrier portion comprising:
i) a back panel configure along a back side;
ii) a carrier panel configured along a carrier side;
iii) a carrier opening between the back panel and carrier panel for receiving a baby therein;
iv) shoulder straps that extend from the carrier side;
v) a carrier attachment feature configured on the back side and configured to detachably attach the backpack portion to the baby carrier portion by engagement with the backpack attachment feature;
vi) a permeable panel configured on an inside surface of the carrier panel;

wherein the permeable panel has a breathable permeability sufficient for breathing therethrough wherein the carrier attachment feature and the backpack attachment feature couple together to form a zipper; and wherein the zipper extends around a substantial portion of the perimeter of the back side of the baby carrier portion.

15. The convertible baby carrier backpack system of claim 14, wherein the shoulder straps of the baby carrier portion extends from a top of the baby carrier portion to form a loop that connects back to the baby carrier portion; wherein leg openings are configured below the shoulder strap in the baby carrier portion.

16. The convertible baby carrier backpack system of claim 14, wherein the back panel of the baby carrier portion is formed by the proximal panel of the backpack portion and wherein the carrier panel is attached to the backpack portion to form the carrier opening between the carrier panel and the proximal panel of the backpack.

17. The convertible baby carrier backpack system of claim 16, wherein the carrier panel is detachably attachable to the backpack.

18. The convertible baby carrier backpack system of claim 16, wherein carrier panel is attached along opposing sides of the backpack and along a bottom of the carrier panel to form leg openings between the carrier panel and the back portion of the backpack.

19. The convertible baby carrier backpack system of claim 14, wherein the back panel is detachably attachable to the proximal panel of the backpack and wherein the carrier panel is attached to the backpack portion to form the carrier opening between the carrier panel and the proximal panel of the backpack.

* * * * *